US011474445B2

(12) United States Patent
Ishizuka et al.

(10) Patent No.: US 11,474,445 B2
(45) Date of Patent: Oct. 18, 2022

(54) CLEANING DEVICE FOR CLEANING A DISCHARGE WIRE, CHARGER, AND IMAGE FORMING APPARATUS

(71) Applicants: Yusuke Ishizuka, Kanagawa (JP); Akira Fujimori, Kanagawa (JP); Hideki Kimura, Kanagawa (JP); Hiroshi Kikuchi, Kanagawa (JP); Yutaka Takahashi, Kanagawa (JP)

(72) Inventors: Yusuke Ishizuka, Kanagawa (JP); Akira Fujimori, Kanagawa (JP); Hideki Kimura, Kanagawa (JP); Hiroshi Kikuchi, Kanagawa (JP); Yutaka Takahashi, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 17/486,921

(22) Filed: Sep. 28, 2021

(65) Prior Publication Data

US 2022/0107579 A1 Apr. 7, 2022

(30) Foreign Application Priority Data

Oct. 7, 2020 (JP) ..... JP2020-169656

(51) Int. Cl.
*G03G 15/02* (2006.01)

(52) U.S. Cl.
CPC ..... *G03G 15/0258* (2013.01)

(58) Field of Classification Search
CPC ..... G03G 15/0225; G03G 15/0258; G03G 15/0291
USPC ..... 399/100
See application file for complete search history.

(56) References Cited

U.S. PATENT DOCUMENTS

| | | | | |
|---|---|---|---|---|
| 8,311,441 | B2 * | 11/2012 | Inoue | G03G 15/0258 399/100 |
| 8,526,844 | B2 * | 9/2013 | Ichikawa et al. | G03G 15/02 399/100 |
| 9,280,080 | B2 * | 3/2016 | Uenishi et al. | G03G 15/0258 |
| 10,095,148 | B2 * | 10/2018 | Kitagawa et al. | G03G 15/0225 |
| 2009/0180795 | A1 | 7/2009 | Karasawa et al. | |
| 2014/0270847 | A1 | 9/2014 | Uenishi et al. | |
| 2016/0209771 | A1 | 7/2016 | Maehata et al. | |

FOREIGN PATENT DOCUMENTS

| | | |
|---|---|---|
| JP | 10-090980 | 4/1998 |
| JP | 2013-07686 | 4/2013 |

* cited by examiner

*Primary Examiner* — William J Royer
(74) *Attorney, Agent, or Firm* — Xsensus LLP

(57) ABSTRACT

A cleaning device cleans a discharge wire that discharges electric charge onto a discharge target. The cleaning device moves in a longitudinal direction oldie discharge wire. The cleaning device includes a first contact portion that contacts and cleans the discharge wire and a second contact portion that contacts and cleans the discharge wire. When the first contact portion and the second contact portion clean the discharge wire, the first contact portion and the second contact portion sandwich the discharge wire in a discharge direction in which the discharge wire discharges the electric charge onto the discharge target. The discharge direction is parallel to a radial direction of the discharge wire.

16 Claims, 7 Drawing Sheets

CLEANING DEVICE FOR CLEANING A DISCHARGE WIRE, CHARGER, AND IMAGE FORMING APPARATUS

CROSS-REFERENCE TO RELATED APPLICATION

This patent application is based on and claims priority pursuant to 35 U.S.C. § 119(a) to Japanese Patent Application. No. 2020-169656, filed on Oct. 7, 2020, in the Japan Patent Office, the entire disclosure of which is hereby incorporated by reference herein.

BACKGROUND

Technical Field

Exemplary aspects of the present disclosure relate to a cleaning device, a charger, and an image forming apparatus, and more particularly, to a cleaning device, a charger incorporating the cleaning device, and an image forming apparatus incorporating the charger.

Discussion of the Background Art

Related-art image forming apparatuses, such as copiers, facsimile machines, printers, and multifunction peripherals (MFP) having two or more of copying, printing, scanning, facsimile, plotter, and other functions, typically form an image on a recording medium according to image data by electrophotography.

Such image forming apparatuses include a cleaning device that cleans a discharge wire. The cleaning device includes a pair of contact portions that contacts the discharge wire. As the cleaning device moves in a longitudinal direction of the discharge wire in a state in which the pair of contact portions sandwiches the discharge wire the pair of contact portions cleans the discharge wire.

SUMMARY

This specification describes below an improved cleaning device. In one embodiment, the cleaning device cleans a discharge wire that discharges electric charge onto a discharge target. The cleaning device moves in a longitudinal direction of the discharge wire. The cleaning device includes a first contact portion that contacts and cleans the discharge wire and a second contact portion that contacts and cleans the discharge wire. When the first contact portion and the second contact portion clean the discharge wire, the first contact portion and the second contact portion sandwich the discharge wire in a discharge direction in which the discharge wire discharges the electric charge onto the discharge target. The discharge direction is parallel to a radial direction of the discharge wire.

This specification further describes an improved charger. In one embodiment, the charger includes a discharge wire that discharges electric charge onto a discharge target in a discharge direction and a cleaner that cleans the discharge wire. The cleaner includes a first contact portion that contacts and cleans the discharge wire and a second contact portion that contacts and cleans the discharge wire. The first contact portion and the second contact portion sandwich the discharge wire in the discharge direction that is parallel to a radial direction of the discharge wire when the first contact portion and the second contact portion clean the discharge wire.

This specification further describes an improved image forming apparatus. In one embodiment, the image forming apparatus includes a latent image bearer and a charger that uniformly charges a surface of the latent image bearer. The charger includes a discharge wire that discharges electric charge onto the latent image bearer in a discharge direction. A cleaning device cleans the discharge wire. A driver moves the cleaning device in a longitudinal direction of the discharge wire. The cleaning device includes a first contact portion that is disposed opposite the latent image bearer via the discharge wire. The first contact portion contacts and cleans the discharge wire. The cleaning device further includes a second contact portion that is interposed between the discharge wire and the latent image bearer. The second contact portion contacts and cleans the discharge wire.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

Figure 1:
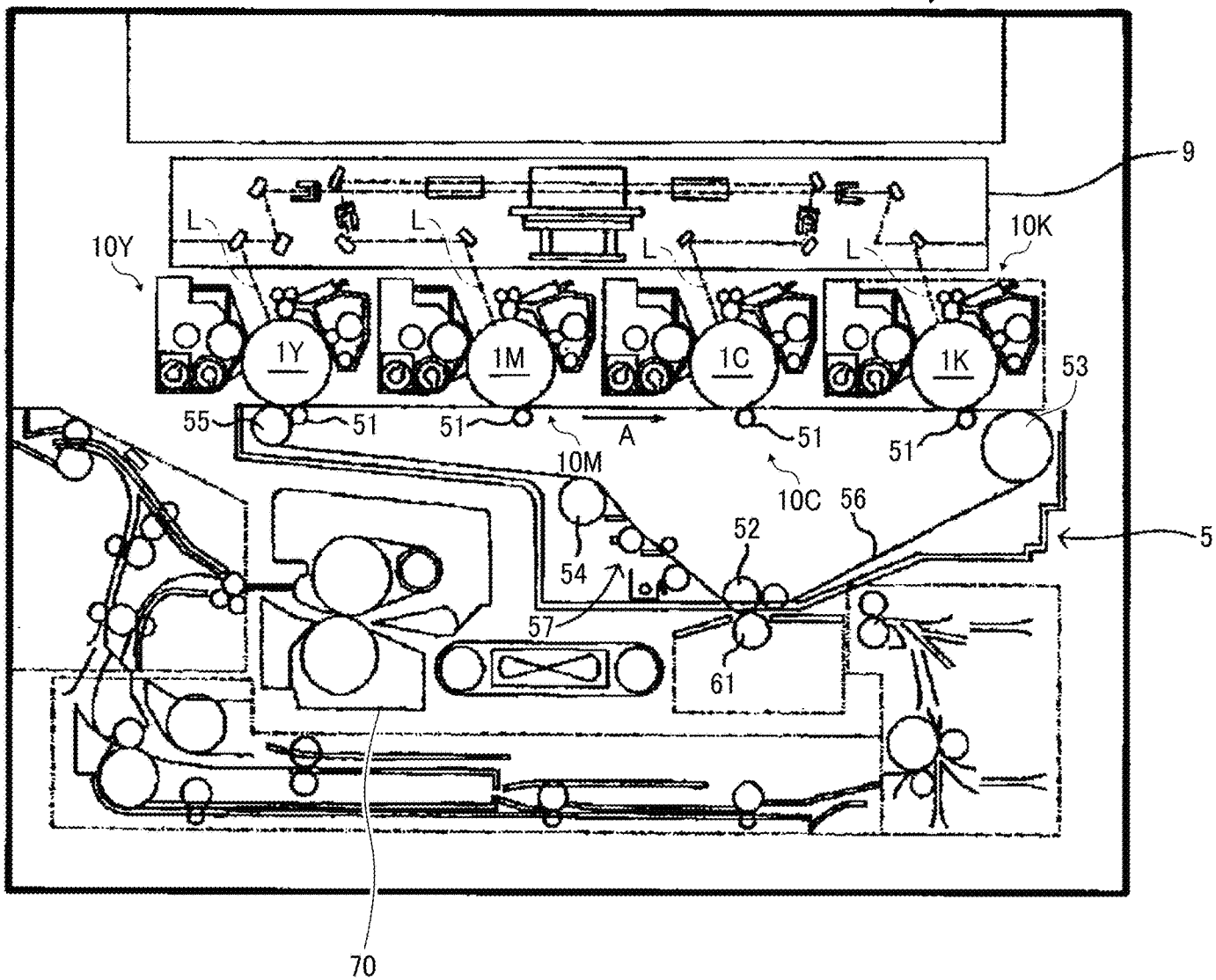
FIG. 1 is a schematic cross-sectional view of a printer according to an embodiment of the present disclosure.

The accompanying drawings are intended to depict embodiments of the present disclosure and should not be interpreted to limit the scope thereof. The accompanying drawings are not to be considered as drawn to scale unless explicitly noted. Also, identical or similar reference numerals designate identical or similar components throughout the several views.

DETAILED DESCRIPTION

In describing embodiments illustrated in the drawings, specific terminology is employed for the sake of clarity. However, the disclosure of this specification is not intended to be limited to the specific terminology so selected and it is to be understood that each specific element includes all technical equivalents that, have a similar function, operate in a similar manner, and achieve a similar result.

As used herein, the singular forms "a", "an", and "the" are intended to include the plural forms as well, unless the context clearly indicates otherwise.

A description is provided of a construction of a printer 100, serving as an image forming apparatus that forms an image on a recording medium by electrophotography, according to an embodiment of the present disclosure.

FIG. 1 is a schematic cross-sectional view of the printer 100 according to this embodiment.

The printer 100 includes an intermediate transfer device 5 serving as a transferor disposed inside the printer 100 at substantially a center of the printer 100. The intermediate transfer device 5 includes an intermediate transfer belt serving as an intermediate transferor. The intermediate transfer belt 56 is an endless belt that is looped over and supported by four rollers 52, 53, 54, and 55 and is driven and rotated in a rotation direction A. Above the intermediate transfer belt 56 are four image forming units 10Y, 10M, 10C, and 10K that form toner images in yellow (Y), magenta (M), cyan (C), and black (K), respectively. The image forming units 10Y, 10M, 10C, and 10K are arranged on a surface of the intermediate transfer belt 56 in the rotation direction A thereof.

Figure 2:
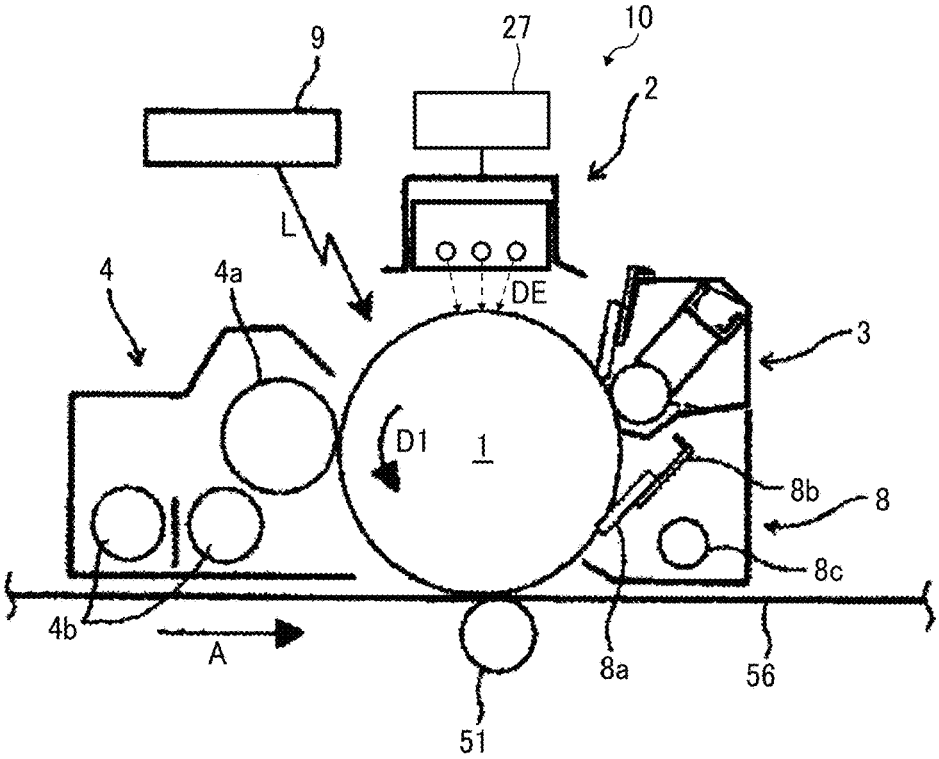
FIG. 2 is an enlarged view of one of four image forming units incorporated in the printer depicted in FIG. 1.

FIG. 2 is an enlarged view of an image forming unit 10, that is, one of the image forming units 10Y, 10M, 10C, and 10K.

Since the image thrilling units 10Y, 10M, 10C, and 10K have a similar construction, the image forming unit 10 omits suffixes Y, M, C, and K that represent colors, respectively. The image forming unit 10 includes a photoconductor 1 that represents one of photoconductors 1Y, 1M, 1C, and 1K depicted in FIG. 1 and serves as a latent image bearer. The photoconductor 1 is surrounded by a charger 2 serving as charging means, a developing device 4 serving as developing means, a photoconductor cleaner 8 serving as cleaning means, a lubricant applicator 3, and the like.

As illustrated in FIG. 1, an exposure device 9 is disposed above the four image forming units 10Y, 10M, 10C, and 10K. The exposure device 9 serves as exposure means that emits laser beams L onto charged surfaces of the photoconductors 1Y, 1M, 1C, and 1K according to yellow, magenta, cyan, and black image data, respectively, thus writing electrostatic latent images on the photoconductors 1Y, 1M, 1C, and 1K. Primary transfer rollers 51 are disposed opposite the photoconductors 1Y, 1M, 1C, and 1K, respectively, via the intermediate transfer belt 56. The primary transfer rollers 51 primarily transfer yellow, magenta, cyan, and black toner images formed on the photoconductors 1Y, 1M, 1C, and 1K onto the intermediate transfer belt 56, respectively, thus forming at color toner image on the intermediate transfer belt 56.

A secondary transfer roller 61 is disposed outside a loop formed by the intermediate transfer belt 56 and pressed against the roller 52 via the intermediate transfer belt 56. The secondary transfer roller 61 contacts the intermediate transfer belt 56 at a secondary transfer nip (e.g., a secondary transfer portion) where the color toner image formed on the intermediate transfer belt 56 is secondarily transferred onto a transfer sheet serving as a recording medium. A belt cleaner 57 is disposed downstream from the secondary transfer roller 61 in the rotation direction A of the intermediate transfer belt 56. A fixing device 70 is disposed on the left of the secondary transfer nip in FIG. 1. The fixing device 70 fixes the color toner image transferred onto the transfer sheet thereon. A sheet feeding device is disposed in a lower portion of the printer 100. The sheet feeding device loads a plurality of transfer sheets and feeds a transfer sheet to the secondary transfer nip.

A description is provided of image forming processes performed by the printer 100 having the construction described above.

In each of the four image forming units 10Y, 10M, 10C, and 10K, the charger charges the surface of the photoconductor 1 uniformly at a target charge electric potential having a negative polarity, for example. The exposure device 9 emits a laser beam L onto the charged surface of the photoconductor 1 according to image data, decreasing the electric potential of an irradiated portion on the surface of the photoconductor 1, which is irradiated with the laser beam L, and forming an electrostatic latent image an the photoconductor 1. Thereafter, the developing device 4 supplies toner onto the electrostatic latent image having a decreased electric potential, developing the electrostatic latent image into a toner image. Thus, yellow, magenta, cyan, and black toner images are formed on the photoconductors 1Y, 1M, 1C, and 1K, respectively.

The primary transfer rollers 51 applied with a bias voltage transfer the yellow, magenta, cyan, and black toner images formed on the photoconductors 1Y, 1M, 1C, and 1K, respectively, onto the intermediate transfer belt 56 successively such that the yellow, magenta, cyan, and black toner images are superimposed on the intermediate transfer belt 56, thus forming a composite toner image on the intermediate transfer belt 56. At a time when the composite toner image formed on the intermediate transfer belt 56 reaches the secondary transfer nip, the sheet feeding device feeds a transfer sheet to the secondary transfer nip. The secondary transfer roller 61 applied with a bias voltage transfers the composite toner image formed on the intermediate transfer belt 56 onto the transfer sheet. The fixing device 70 fixes the composite toner image on the transfer sheet, thus forming a color toner image on the transfer sheet. After the toner image formed on the photoconductor 1 is transferred onto the intermediate transfer belt 56, the photoconductor cleaner 8 removes a foreign substance adhered to the photoconductor 1 therefrom. The foreign substance includes residual toner failed to be transferred onto the intermediate transfer belt 56 and therefore remaining on the photoconductor 1. Thus, the photoconductor 1 is ready for a next image forming job. After the composite toner image termed on the intermediate transfer belt 56 is transferred onto the transfer sheet, the belt cleaner 57 removes a foreign substance adhered to the intermediate transfer belt 56 therefrom. The foreign substance includes residual toner failed to be transferred onto the transfer sheet and therefore remaining on the intermediate transfer belt 56. Thus, the intermediate transfer belt 56 is ready for the next image forming job.

The photoconductor 1 according to this embodiment is an organic photoconductor and includes a surface protective layer made of polycarbonate resin.

The developing device 4 according to this embodiment contains a developer including magnetic carrier particles and charged toner particles. The developing device 4 includes two stirring-conveying screws 4*b* that circulate the developer inside the developing device 4. The developing device 4 further includes a developing roller 4*a* serving as a developer bearer that is disposed opposite the surface of the photoconductor 1 that rotates in a rotation direction D1. The developing roller 4*a* includes a developing sleeve that is tubular and a magnet disposed inside the developing sleeve. A surface of the developing sleeve bears the developer with a magnetic force. As the developing sleeve is driven and rotated, the developing sleeve conveys the developer to a developing position disposed opposite the photoconductor 1.

As the stirring-conveying screws 4*b* convey the developer to the developing roller 4*a* and therefore the developing roller 4*a* bears the developer, the developing roller 4*a* that rotates conveys the developer to the developing position. The developing roller 4*a* is applied with a predetermined developing voltage having a negative polarity, for example. The developing voltage generates a ground potential between a surface electric potential of the developing roller 4*a* and an electric potential of a non-imaging portion (e.g., a ground portion) where no electrostatic latent image is formed on the surface of the photoconductor 1. The developing voltage generates a developing potential between a surface electric potential of the developing roller 4*a* and an electric potential of an imaging portion where an electrostatic latent image is formed on the surface of the photoconductor 1. The ground potential electrostatically moves charged toner charged with a regular charging polarity (e.g., a negative polarity) to the developing roller 4*a*, restricting adhesion of the charged toner to the non-imaging portion (e.g., the ground portion) on the photoconductor 1. The developing potential electrostatically moves the charged toner charged with the regular charging polarity to the imaging portion on the photoconductor 1, adhering the charged toner to the imaging portion on the photoconductor 1. The ground potential and the developing potential selectively adhere the charged toner to the imaging portion where the electrostatic latent image is formed on the photoconductor 1 by the exposure device 9, developing the electrostatic latent image into a toner image.

The photoconductor cleaner 8 includes a cleaning blade 8*a* serving as a cleaning member that cleans the photoconductor 1, a support 8*b*, and a toner collecting coil 8*c*. The cleaning blade 8*a* is a plate made of rubber such as urethane rubber and silicone rubber. An edge of the cleaning blade 8*a* contacts the surface of the photoconductor 1 and removes residual toner failed to be transferred onto the intermediate transfer belt 56 and therefore remaining on the photoconductor 1 and a part of a lubricant applied to the photoconductor 1 by the lubricant applicator 3 from the photoconductor 1. The cleaning blade 8*a* is attached to and supported by the support 8*b* made of metal, plastic, ceramic, or the like. The cleaning blade 8*a* is angled relative to the surface of the photoconductor 1 at a predetermined angle. Instead of the cleaning blade 8*a*, a cleaning brush or the like may be employed as a cleaning member that cleans the photoconductor 1.

Figure 3:
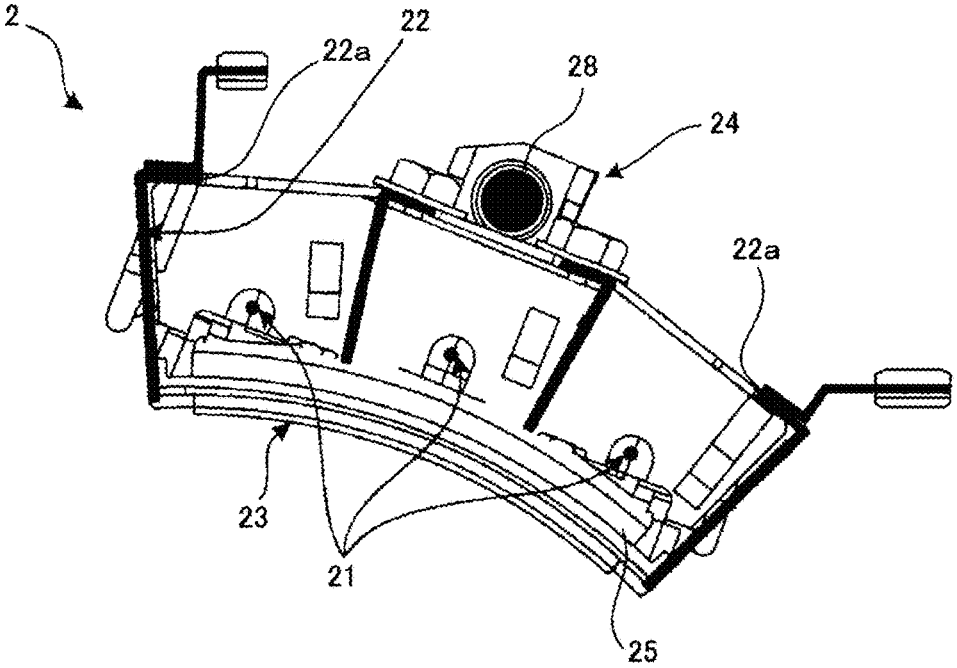
FIG. 3 is a schematic diagram of a charger incorporated in the image forming unit depicted in FIG. 2.

FIG. 3 is a schematic cross-sectional view of the charger 2.

The charger 2 includes three discharge wires 21, a shield case 22, and a grid electrode 23. The shield case 22 separates the discharge wires 21 from each other. A power supply is coupled to each of the discharge wires 21 and the grid electrode 23. As a high voltage is applied to each of the discharge wires 21 and the grid electrode 23, corona discharge generates between the photoconductor 1 serving as a discharge target and the discharge wires 21, charging the surface of the photoconductor 1 uniformly. The grid electrode 23 has a shape that fits a curvature of the photoconductor 1, improving control of the electric potential of the photoconductor 1.

A surface of each of the discharge wires 21 is treated with palladium plating. Palladium plating is harder than gold plating and does not peel off easily compared to gold plating. An ionization tendency of palladium plating is lower than an ionization tendency of gold plating. Hence, palladium plating improves cleaning performance of a wire cleaner described below.

A foreign substance such as toner, a discharge product, and paper dust is adhered to the grid electrode 23 and the discharge wires 21 over time, causing uneven discharge that degrades charging performance of the charger 2 and hindering uniform charging by the charger 2. Accordingly, the charger 2 may not charge the photoconductor 1 uniformly, causing uneven density of a toner image in a main scanning direction (e.g., an axial direction of the photoconductor 1) in which the laser beam L emitted by the exposure device 9 scans the surface of the photoconductor 1. Consequently, the toner image may suffer from a vertical streak, a vertical band, and the like that extend in a sub-scanning direction (e.g., the rotation direction D1 of the photoconductor 1) that is perpendicular to the main scanning direction, To address this circumstance, in order to retain stable charging performance of the charger 2 over time also, the charger 2 includes a charger cleaning device 24 serving as cleaning means or a cleaning device that cleans the grid electrode 23 and each of the discharge wires 21.

Figure 4:
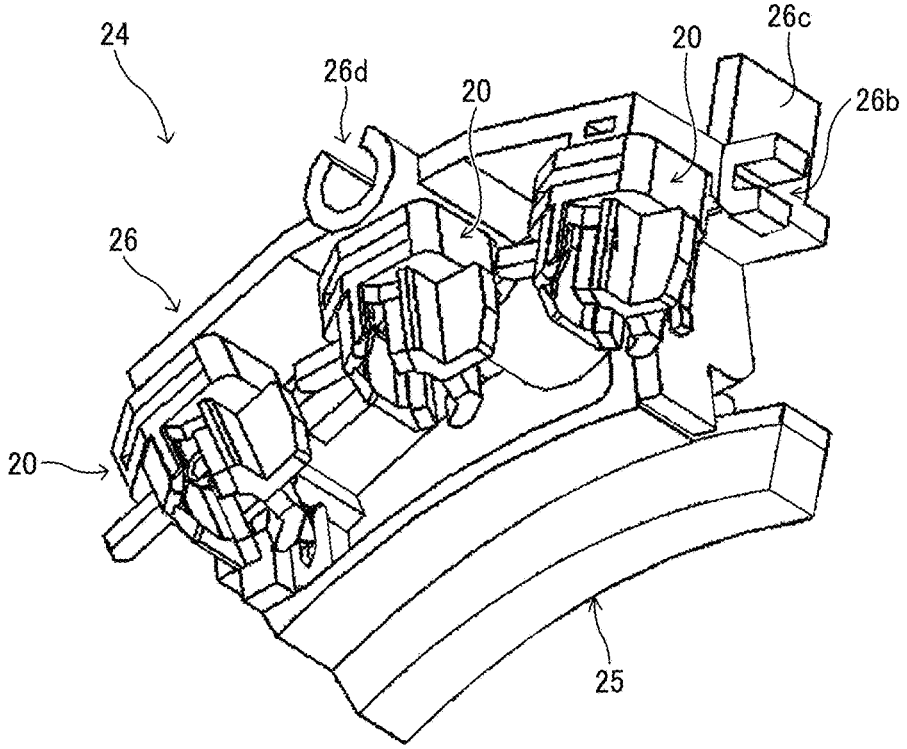
FIG. 4 is a schematic perspective view of a charger cleaning device incorporated in the charger depicted in FIG. 3.
Figure 5:
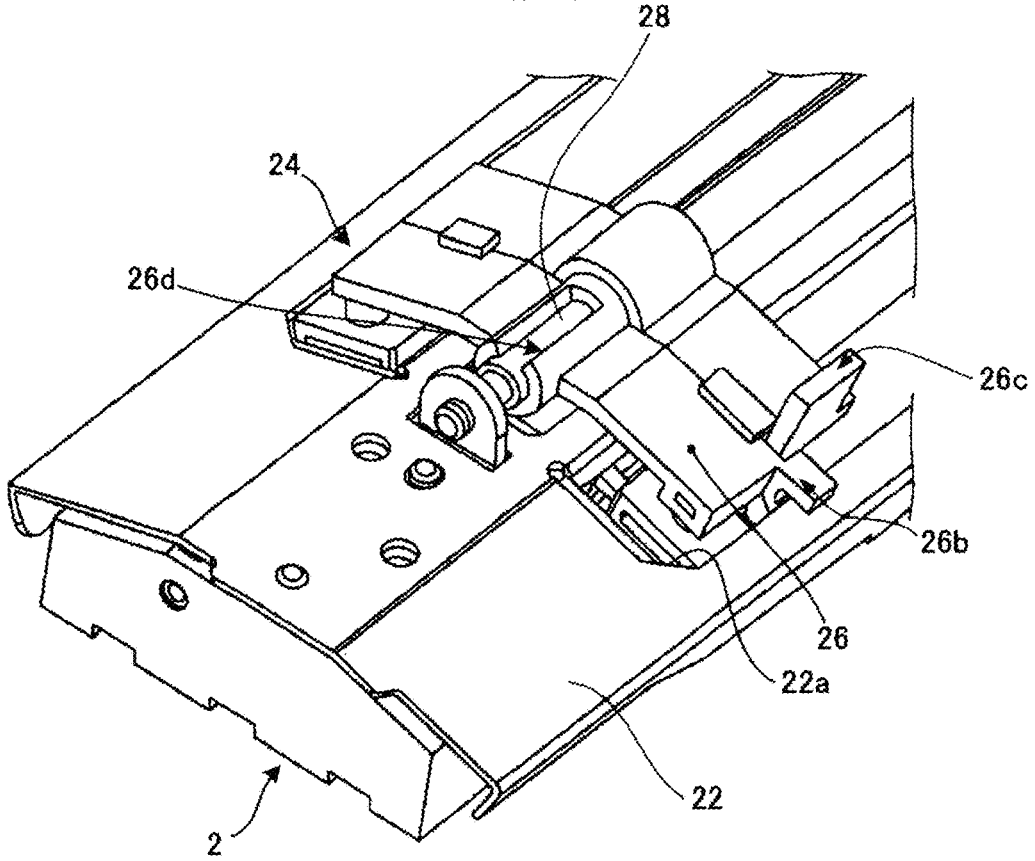
FIG. 5 is a perspective view of the charger depicted in FIG. 3, illustrating one lateral end of the charger in a main scanning direction.

FIG. 4 is a schematic perspective view of the charger cleaning device 24 seen from the photoconductor 1 depicted in FIG. 2. FIG. 5 is a perspective view of one lateral end of the charger 2 in the main scanning direction.

As illustrated in FIG. 4, the charger cleaning device 24 serving as a cleaning device includes three wire cleaners 20 that are disposed opposite the discharge wires 21 and dean the discharge wires 21, respectively. The charger cleaning device 24 further includes a grid electrode cleaner 25 and a cleaner support 26. The grid electrode cleaner 25 cleans the grid electrode 23 depicted in FIG. 3. The cleaner support 26 supports or holds the wire cleaners 20 and the grid electrode cleaner 25. The three wire cleaners 20 are pivotally attached to the cleaner support 26.

The cleaner support 26 includes a tube 26*d* having an inner circumferential face that mounts a female screw. As illustrated in FIG. 5 the tube 26*d* screws with a feed screw 28. The cleaner support 26 further includes a detent 26*b* that prevents rotation of the cleaner support 26. A clearance hole 22*a* is disposed in an upper face of the shield case 22. The charger cleaning device 24 penetrates through the clearance hole 22*a*. As the detent 26*b* engages the clearance hole 22*a*, the detent 26*b* prevents rotation of the cleaner support 26.

The cleaner support 26 further includes a detected portion 26*c* to be detected. An optical sensor is disposed at one lateral end of the charger 2 in the main scanning direction. The optical sensor is a transmission type sensor that detects that the charger cleaning device 24 is situated at a home position disposed at one lateral end of the charger 2 in the main scanning direction. When the charger cleaning device 24 is situated at the home position, the detected portion 26*c* of the cleaner support 26 is interposed between a light emitter and a light receiver of the optical sensor and blocks light emitted from the light emitter. Thus, the optical sensor detects that the charger cleaning device 24 is situated at the home position.

A driving force is transmitted from a stepping motor 27 depicted in FIG. 2, serving as a driver, to the feed screw 28. A controller controls the stepping motor 27 based on a detection result sent from the optical sensor.

Figure 6:
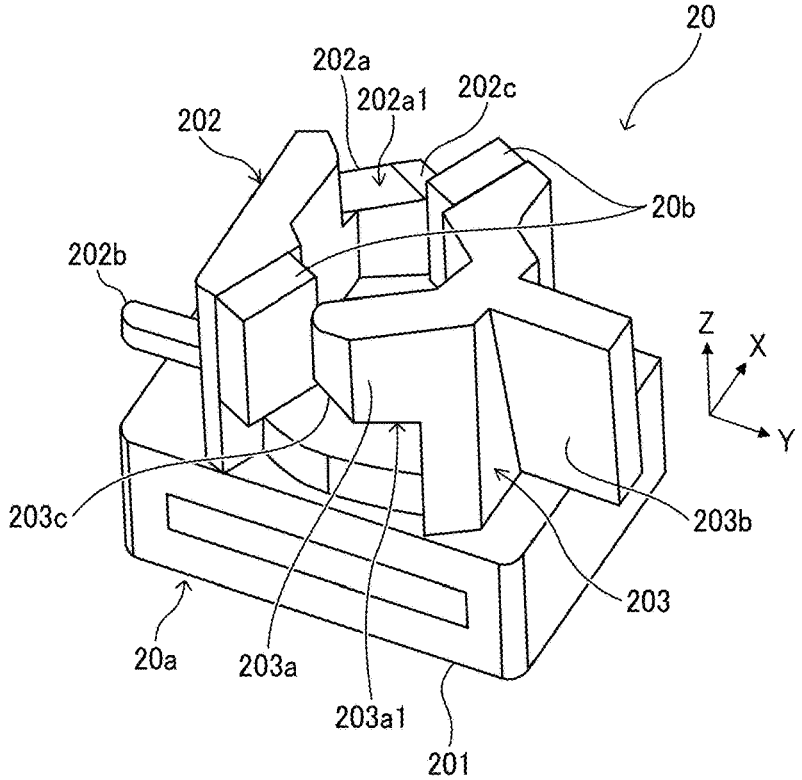
FIG. 6 is a schematic perspective view of a wire cleaner incorporated in the charger clearing device depicted in FIG. 4.

FIG. 6 is a schematic perspective view of the wire cleaner 20.

In a description below, the main scanning direction (e.g., a longitudinal direction of the discharge wire 21) is defined as X-direction properly. The sub-scanning direction (e.g., the rotation direction D1 of the photoconductor 1) is defined as Y-direction properly. A discharge direction DE of the discharge wire 21 (e.g., a normal direction of the photoconductor 1) is defined as Z-direction properly.

The wire cleaner 20 includes a body 20*a* made of resin containing glass. The body 20*a* includes a base 201 that is pivotally supported by the cleaner support 26 depicted in FIG. 5. The body 20*a* further includes a pair of cleaning portions 202 and 203 that is mounted on the base 201 and is perpendicular to the base 201. The cleaning portion 202 is disposed opposite the cleaning portion 203 in Y-direction e.g the sub-scanning direction) via the discharge wire 21. The cleaning portions 202 and 203 include scrapers 202*a* and 203*a*, respectively, that scrape a foreign substance adhered to the discharge wire 21 therefrom. One of the scrapers 202*a* and 203*a*, that is, the scraper 202*a* of the cleaning portion 202 disposed at a negative side in Y-direction, is disposed at a first lateral end of the cleaning portion 202 in the main scanning direction, that is, at a positive side in X-direction. Another one of the scrapers 202*a* and 203*a*, that is, the scraper 203*a* of the cleaning portion 203 disposed at a positive side in Y-direction, is disposed at a second lateral end of the cleaning portion 203 in the main scanning direction, that is, at a negative side in X-direction.

One of the scrapers 202*a* and 203*a*, that is, the scraper 202*a* of the cleaning portion 202, is disposed at a position spaced farther from the photoconductor 1 than the discharge wire 21 is, that is, at a negative side in Z-direction. In other words, the scraper 202*a* is disposed opposite the photoconductor 1 via the discharge wire 21. Another one of the scrapers 202*a* and 203*a*, that is, the scraper 203*a* of the cleaning portion 203, is disposed at a position closer to the photoconductor 1 than the discharge wire 21 is, that is, at a positive side in Z-direction.

One of the scrapers 202*a* and 203*a*, that is, the scraper 202*a* of the cleaning portion 202, includes a scraping face 202*a*1 serving as a contact portion. The scraping face 202*a*1 contacts the discharge wire 21 at the position that is spaced farther from the photoconductor 1 than the discharge wire 21 is, that is, at the negative side in Z-direction. The scraping face 202*a*1 is a curved face having a radius of R0.5. Another one of the scrapers 202*a* and 203*a*, that is, the scraper 203*a* of the cleaning portion 203, includes a scraping face 203*a*1 serving as a contact portion. The scraping face 203*a*1 contacts the discharge wire 21 at the position that is closer to the photoconductor 1 than the discharge wire 21 is, that is, at the positive side Z-direction. For example, the scraping face 202*a*1 is shifted from the scraping face 203*a*1 the longitudinal direction of the discharge wire 21. The scraping face 203*a*1 is a curved face having a radius of R0.5.

The scrapers 202*a* and 203*a* include slopes 202*c* and 203*c*, respectively. The slopes 202*c* and 203*c* are sloping faces that contact and guide the discharge wire 21 to the scraping faces 202*a*1 and 203*a*1, respectively. For example, the slopes 202*c* and 203*c* abut on the scraping faces 202*a*1 and 203*a*1, respectively.

One of the cleaning portions 202 and 203, that is, the cleaning portion 202, includes a contact projection 202*b* that brings the wire cleaner 20 into contact with the discharge wire 21. Another one of the cleaning portions 202 and 203, that is, the cleaning portion 203, includes a release projection 203*b* that releases contact of the wire cleaner 20 with the discharge wire 21.

A cleaning pad 20*b* is mounted on a second lateral end of the cleaning portion 202 in the main scanning direction (e.g., X-direction). The second lateral end of the cleaning portion 202 is opposite to the first lateral end of the cleaning portion 202 where the scraper 202*a* is disposed. Another cleaning pad 20*b* is mounted on a first lateral end of the cleaning portion 203 in the main scanning direction (e.g., X-direction). The first lateral end of the cleaning portion 203 is opposite to the second lateral end of the cleaning portion 203 where the scraper 203*a* is disposed. The cleaning pads 20*b* serve as wipers that wipe the discharge wire 21 to remove the foreign substance adhered to the discharge wire 21 therefrom. The cleaning pads 20*b* are attached to opposed faces of the cleaning portions 202 and 203, respectively, which are disposed opposite the discharge wire 2 in the sub-scanning direction (e.g., Y-direction) with double-sided tape or the like. In order to attract or absorb the foreign substance adhered to the discharge wire 21 properly, the cleaning pads 20*b* are preferably made of a porous material such as elastic foam or fiber such as felt.

Figure 7:
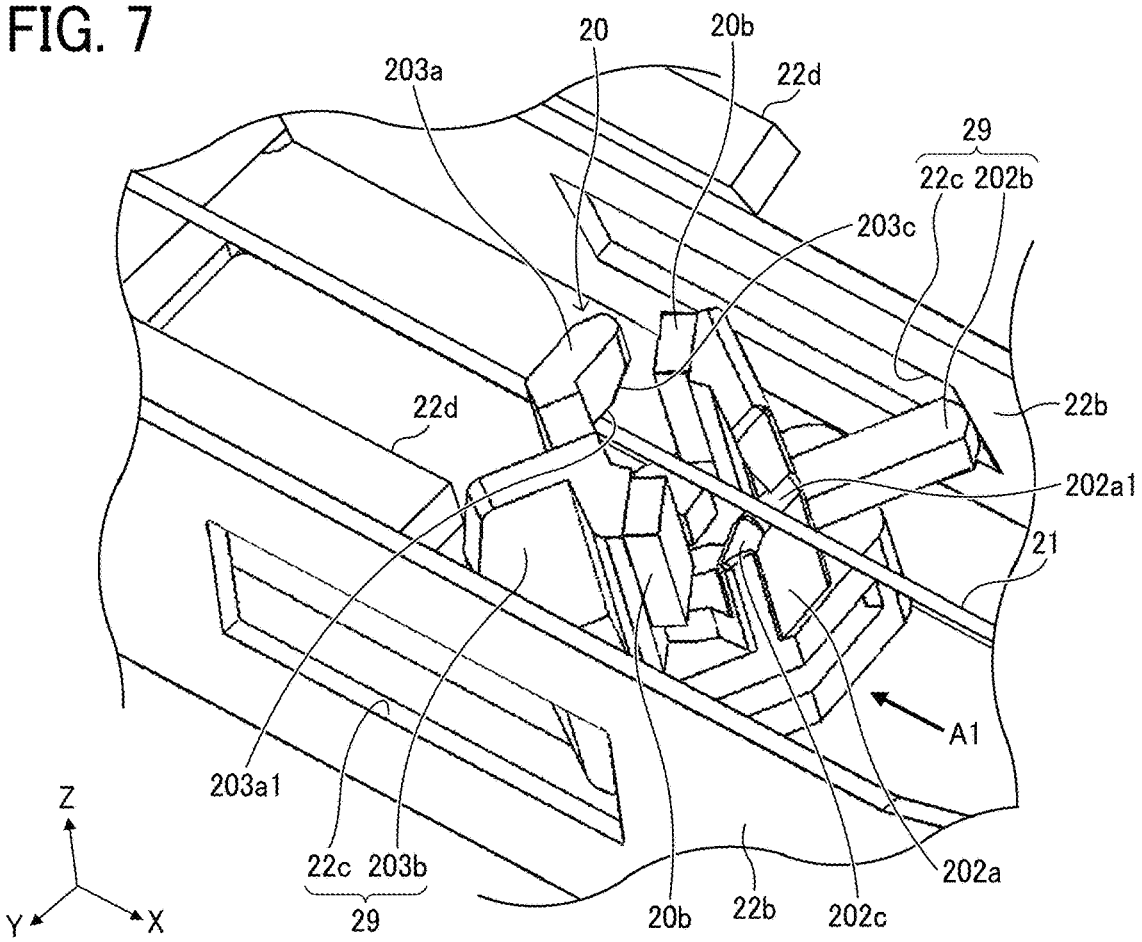
FIG. 7 is a schematic perspective view of a pivot mechanism that is incorporated in the charger depicted in FIG. 3 and pivots the wire cleaner situated at one lateral end of the charger in the main scanning direction.
Figure 8:
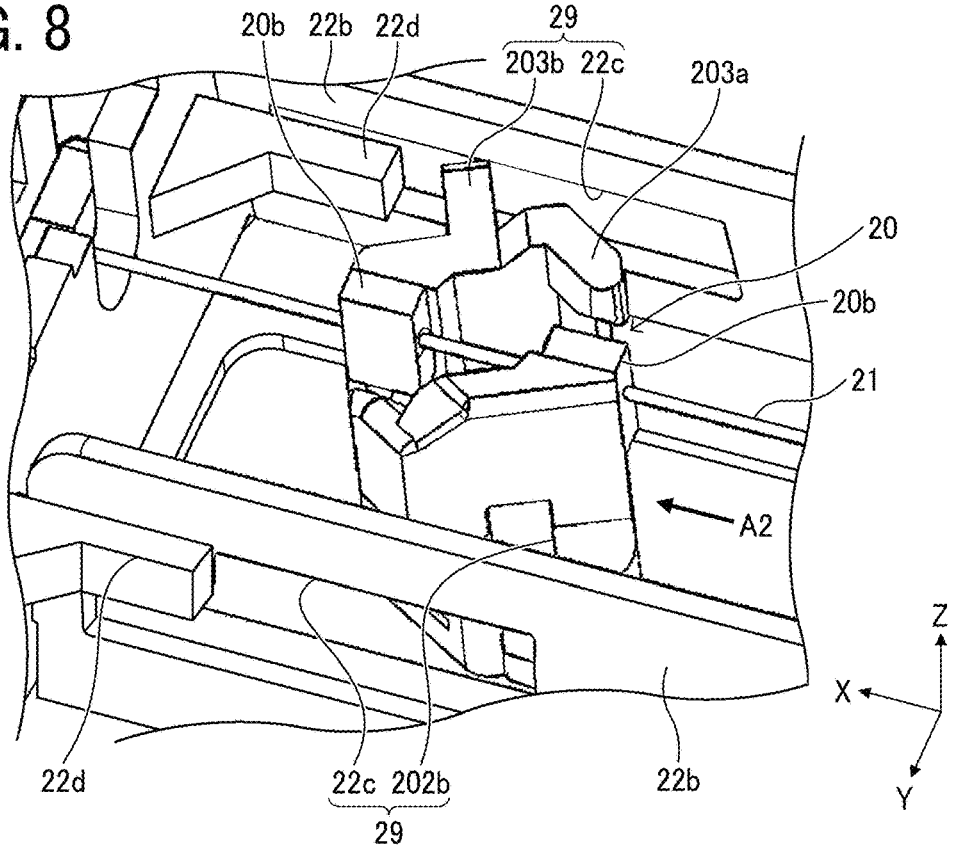
FIG. 8 is a schematic perspective view of a pivot mechanism that is incorporated in the charger depicted in FIG. 3 and pivots the wire cleaner situated at another lateral end of the charger in the main scanning direction.

FIG. 7 is a schematic perspective view of a pivot mechanism 29 that pivots the wire cleaner 20 situated at one lateral end of the charger 2 in the main scanning direction, that is, at the negative side in X-direction. The pivot mechanism 29 includes the clearance hole 22*c* and the contact projection 202*b*. FIG. 8 is a schematic perspective view of the pivot mechanism 29 that pivots the wire cleaner 20 situated at another lateral end of the charger 2 in the main scanning direction, that is, at the positive side in X-direction. The pivot mechanism 29 includes the clearance hole 22*c* and the release projection 203*b*.

As illustrated in FIGS. 7 and 8, the charger 2 includes abutment portions 22*d* disposed at both lateral ends of the charger 2 in X-direction, respectively. Each of the abutment portions 22*d* contacts the release projection 203*b*, separating the wire cleaner 20 from the discharge wire 21. The shield case 22 includes partition walls 22*b* that separate the discharge wires 21 from each other. Clearance holes 22*c* are disposed at both lateral ends of each of the partition walls 22*b* in X-direction. The contact projection 202*b* moves through the clearance hole 22*c*.

When the charger cleaning device 24 is situated at the home position in one lateral end of the charger 2 in the main scanning direction, that is, at the negative side in X-direction, the release projection 203*b* contacts a tip of the abutment portion 22*d*. The wire cleaner 20 is not inclined in the main scanning direction. The scraping faces 202*a*1 and 203*a*1 and the cleaning pads 20*b* are separated from the discharge wire 21. A tip of the contact projection 202*b* enters the clearance hole 22*c*.

Next, a description is provided of a method for cleaning the discharge wire 21.

At a time to start cleaning the discharge wire 21, the charger 2 starts the stepping motor 27 depicted in FIG. 2 and causes the stepping motor 27 to pivot the feed screw 28 depicted in FIG. 3. Accordingly, the charger cleaning device 24 situated at the home position moves from one lateral end to another lateral end of the charger 2 in the main scanning direction. When the charger cleaning device 24 starts moving from one lateral end to another lateral end of the charger 2 in the main scanning direction, the tip of the contact projection 202*b* entering the clearance hole 22*c* depicted in FIG. 7 comes into contact with a lateral end of the clearance hole 22*c*, which is closer to another lateral end of the charger 2 in the main scanning direction. In a state in which the tip of the contact projection 202*b* contacts the lateral end of the clearance hole 22*c*, which is closer to another lateral end of the charger 2 in the main scanning direction, the charger cleaning device 24 moves, thus pivoting the wire cleaner 20. As the tip of the contact projection 202*b* moves onto the partition wall 22*b*, the discharge wire 21 ascends the slopes 202*c* and 203*c*. When the tip of the contact projection 202*b* moves on the partition wall 22*b*, the discharge wire 21 moves onto the scraping faces 202*a*1 and 203*a*1.

Figure 9:
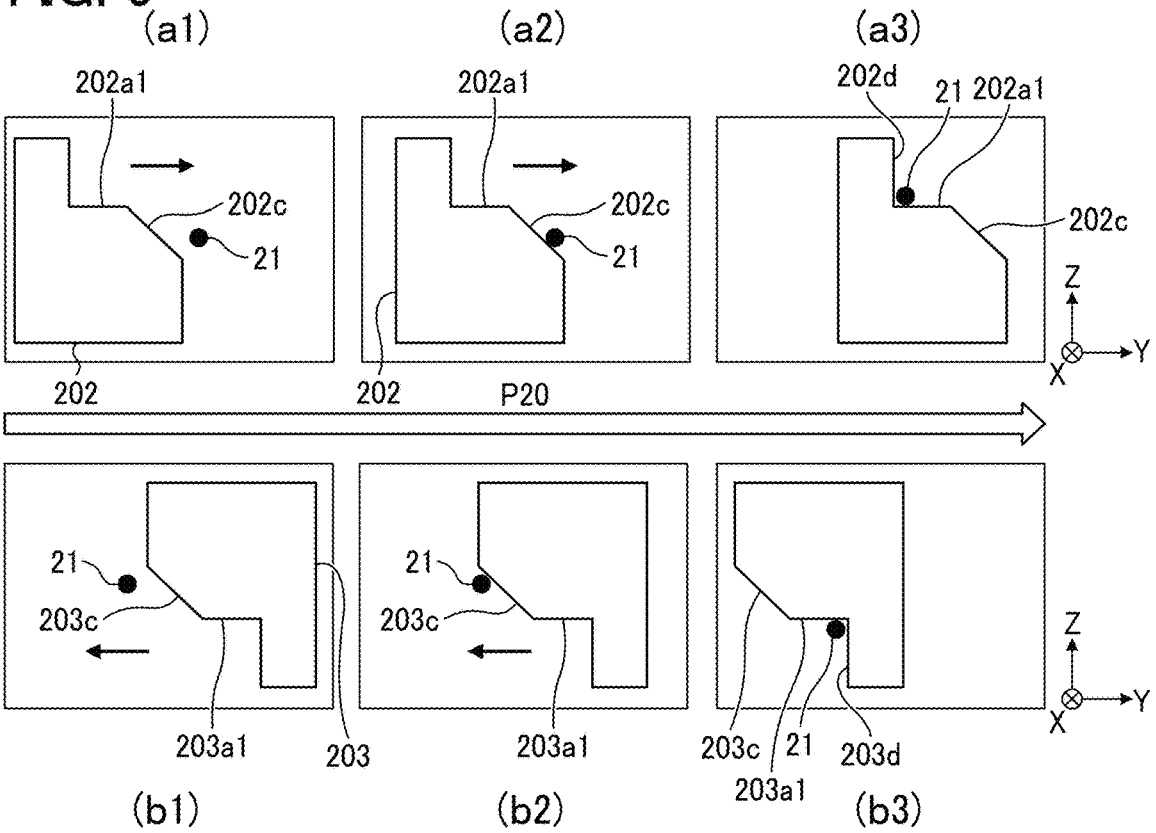
FIG. 9 is a diagram of a discharge wire incorporated in the charger depicted in FIG. 3 and scraping faces incorporated in the wire cleaner depicted in FIG. 6, illustrating the discharge wire that moves onto the scraping faces.

FIG. 9 is a diagram of the discharge wire 21 that moves onto the scraping faces 202*a*1 and 203*a*1. In FIG. 9, a direction P20 indicates progress of pivoting of the wire cleaner 20 depicted in FIG. 7. FIG. 9 illustrates, in sections (a1), (a2), and (a3), the cleaning portion 202, that is, one of the cleaning portions 202 and 201 in sections (a1), (a2), and (a3) in FIG. 9, the discharge wire 21 moves onto the scraping face 202*a*1 of the cleaning portion 202. FIG. 9 illustrates, in sections (b1), (b2), and (b3), the cleaning portion 203, that is, another one of the cleaning portions 202 and 203. In sections (b1), (b2), and (b3) in FIG. 9, the discharge wire 21 moves onto the scraping face 203*a*1 of the cleaning portion 203.

As the wire cleaner 20 pivots, the cleaning portions 202 and 203 move closer to the discharge wire 21 in the sub-scanning direction. As illustrated in sections (a2) and (b2) in FIG. 9, the discharge wire 21 comes into contact with the slopes 202*c* and 203*c*. As the wire cleaner 20 pivots further, a portion of the discharge wire 21, which contacts the slope 202*c* of the cleaning portion 202, moves up on the slope 202*c* in an approaching direction (e.g., +Z-direction) in which the discharge wire 21 moves closer to the photoconductor 1 depicted in FIG. 2. Conversely, a portion of the discharge wire 21, which contacts the slope 203*c* of the cleaning portion 203, moves up on the slope 203*c* in a separating direction (e.g., −Z-direction) in which the discharge wire 21 moves away from the photoconductor 1.

When the discharge wire 21 moves up on the slopes 202*c* and 203*c*, the wire cleaner 20 receives a reactive force from the discharge wire 21 in an opposite direction opposite to a pivot direction of the wire cleaner 20. However, the tip of the contact projection 202*b* depicted in FIG. 7 contacts the lateral end of the clearance hole 22*c*, which is closer to another lateral end of the charger 2 in the main scanning direction, preventing the wire cleaner 20 from pivoting in the opposite direction.

As the wire cleaner 20 pivots further, the discharge wire 21 moves onto the scraping faces 202*a*1 and 203*a*1. When the tip of the contact projection 202*b* moves onto the partition wall 22*b*, as illustrated in sections (a3) and (b3) in FIG. 9, the discharge wire 21 is situated at opposite ends opposite to slope side ends of the scraping faces 202*a*1 and 203*a*1, respectively. The discharge wire 21 contacts side walls 202*d* and 203*d* of the cleaning portions 202 and 203, respectively, in the sub-scanning direction (e.g., Y-direction). The side walls 202*d* and 203*d* serve as secondary contact portions, respectively. The side walls 202*d* and 203*d* abut perpendicularly on the scraping faces 202*a*1 and 203*a*1, respectively. For example, the side wall 202*d* contacts the discharge wire 21 in Y-direction. The side wall 203*d* contacts the discharge wire 21 in +Y-direction.

Figure 10:
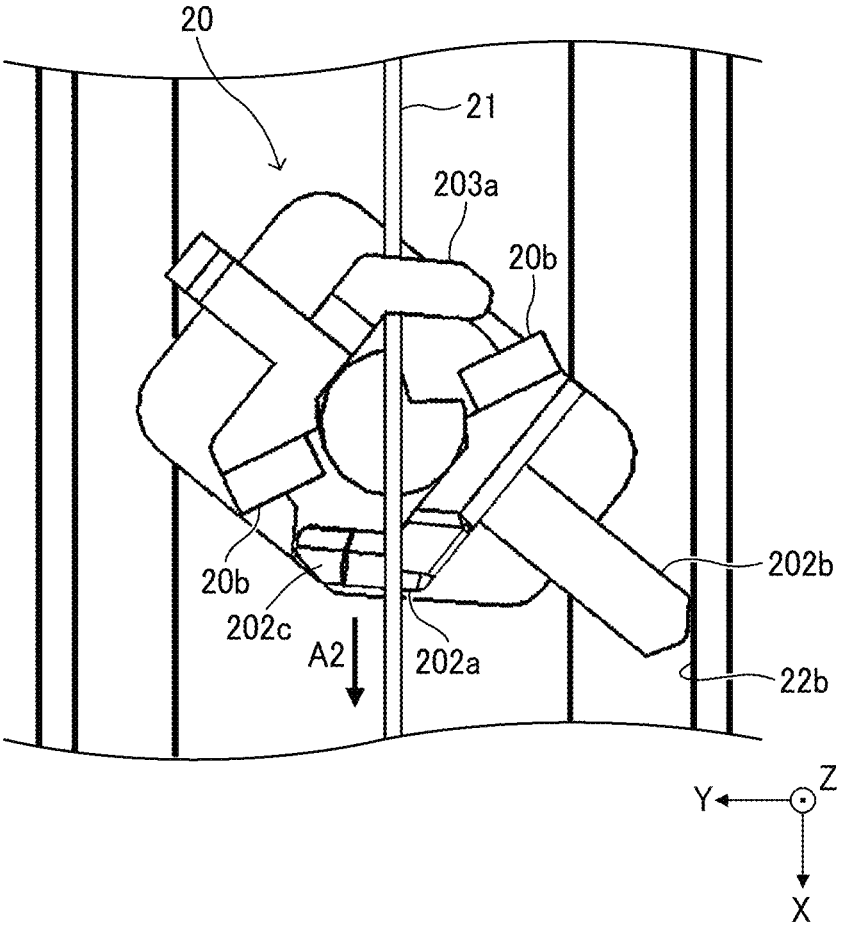
FIG. 10 is a diagram of the wire cleaner depicted in FIG. 6 that cleans the discharge wire, seen from a photoconductor incorporated in the image forming unit depicted in FIG. 2 when the charger cleaning device moves outward from one lateral end to another lateral end of the charger in the main scanning direction.
Figure 11:
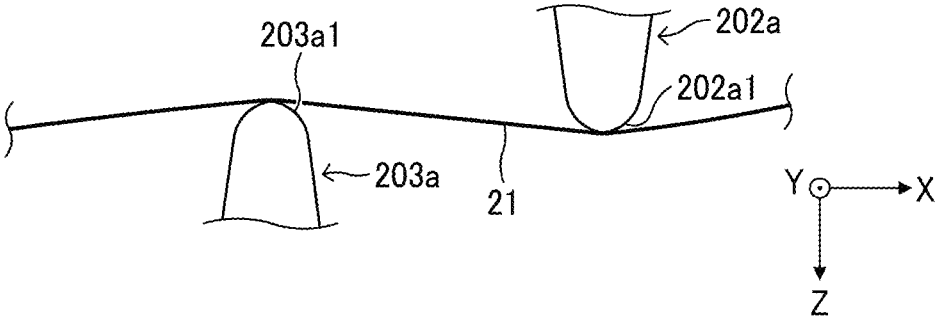
FIG. 11 is a diagram of the wire cleaner depicted in FIG. 6 that cleans the discharge wire, seen from a sub-scanning direction when the charger cleaning device moves outward from one lateral end to another lateral end of the charger in the main scanning, direction.

FIG. 10 is a diagram of the wire cleaner 20 that cleans the discharge wire 21 seen from the photoconductor 1 depicted in FIG. 2 when the charger cleaning device 24 moves outward in a direction A2 from one lateral end to another lateral end of the charger 2 in the main scanning direction. FIG. 11 is a diagram of the wire cleaner 20 that cleans the discharge wire 21 seen in the sub-scanning direction when the charger cleaning device 24 moves outward from one lateral end to another lateral end of the charger 2 in the main scanning direction.

As illustrated in FIGS. 10 and 11, the pair of scraping faces 202*a*1 and 203*a*1 contacts and sandwiches the discharge wire 21 in Z-direction. As illustrated in FIG. 11, the scraping face 202*a*1 is shifted from the scraping face 203*a*1 in the main scanning direction (e.g., X-direction). In a state in which the pair of scraping faces 202*a*1 and 203*a*1 contacts the discharge wire 21, the wire cleaner 20 moves in the main scanning direction (e.g., X-direction). Accordingly, the scraping faces 202*a*1 and 203*a*1 scrape the foreign substance adhered to the discharge wire 21 therefrom.

According to this embodiment, in a state in which the pair of scraping faces 202*a*1 and 203*a*1 sandwiches the discharge wire 21 in Z-direction, the pair of scraping faces 202*a*1 and 203*a*1 cleans the discharge wire 21. Accordingly, the scraping face 203*a*1 removes the foreign substance adhered to an opposed portion of the discharge wire 21 which is disposed opposite the photoconductor 1, from the opposed portion of the discharge wire 21.

The opposed portion of the discharge wire 21, which is disposed opposite the photoconductor 1, discharges electric charge to the photoconductor 1 mainly, thus charging the photoconductor 1. Hence, if the opposed portion of the discharge wire 21, which is disposed opposite the photoconductor 1, is adhered with the foreign substance, the discharge wire 21 is susceptible to uneven discharge. To address this circumstance, according to this embodiment, the scraping face 203*a*1 contacts the discharge wire 21 from a photoconductor side, that is, the positive side in Z-direction. Thus, the scraping face 203*a*1 scrapes and removes the foreign substance adhered to the opposed portion of the discharge wire 21, which is disposed opposite the photoconductor 1, from the opposed portion of the discharge wire 21 properly. Accordingly, the scraping face 203*a*1 prevents the foreign substance from remaining on the opposed portion of the discharge wire 21, which is disposed opposite the photoconductor 1, appropriately after cleaning, thus suppressing, uneven discharge of the discharge wire 21. Consequently, the discharge wire 21 uniformly charges the surface of the photoconductor 1 precisely.

The body 20*a* depicted in FIG. 6 is made of resin containing glass. The scraping faces 202*a*1 and 203*a*1 as a part of the body 20*a* are made of resin containing glass. Since the scraping faces 202*a*1 and 203*a*1 are made of resin containing glass, the scraping faces 202*a*1 and 203*a*1 attain an increased hardness and contact the discharge wire 21 with increased pressure. Accordingly, the scraping faces 202*a*1 and 203*a*1 properly scrape the foreign substance adhered to the discharge wire 21 toughly from the discharge wire 21. As a content of glass contained in the scraping faces 202*a*1 and 203*a*1 increases, a surface roughness of the scraping faces 202*a*1 and 203*a*1 increases. Thus, the scraping faces 202*a*1 and 203*a*1 attain an improved cleaning performance. However, if the content of glass contained in the scraping faces 202*a*1 and 203*a*1 increases, the scraping faces 202*a*1 and 203*a*1 that slide over the discharge wire 21 and the contact projection 202*b* that slides over the partition wall 22*b* depicted in FIG. 7 may disadvantageously suffer from quick abrasion. To address this circumstance, according to this embodiment, the body 20*a* is made of polycarbonate (PC) resin or polyphenylene sulfide (PPS) resin having a content of glass of 40%.

Further, according to this embodiment, as illustrated in sections (a3) and (b3) in FIG. 9, the side walls 202*d* and 203*d* of the cleaning portions 202 and 203, respectively, contact the discharge wire 21 in the sub-scanning direction (e.g., Y-direction). The pair of side walls 202*d* and 203*d* sandwiches the discharge wire 21 in Y-direction. Thus, the side walls 202*d* and 203*d* scrape and remove the foreign substance adhered to sides of the discharge wire 21 therefrom, respectively. Since the pair of side walls 202*d* and 203*d* is also made of resin containing glass, the pair of side walls 202*d* and 203*d* properly scrapes the foreign substance adhered to the discharge wire 21 toughly from the discharge wire 21.

As described above, the wire cleaner 20 according to this embodiment cleans the discharge wire 21 from four directions, that is, +Z-direction, −Z-direction, +Y-direction, and −Y-direction, cleaning the discharge wire 21 precisely.

According to this embodiment, the surface of the discharge wire 21 is treated with palladium plating. As described above, palladium plating does not peel off easily. Accordingly, while the pair of scraping faces 202*a*1 and 203*a*1 and the pair of side walls 202*d* and 203*d* clean the discharge wire 21, palladium plating precisely prevents the surface of the discharge wire 21 from suffering from fine splits and the like caused by peeling of plating.

After the tip of the contact projection 202*b* moves onto the partition wall 22*b*, the partition wall 22*b* restricts pivoting of the wire cleaner 20. Accordingly, the wire cleaner 20 moves in X-direction while retaining a state in which the side walls 202*d* and 203*d* sandwich the discharge wire 21 in Y-direction and the scraping faces 202*a*1 and 203*a*1 sandwich the discharge wire 21 in Z-direction. Consequently, the wire cleaner 20 cleans the discharge wire 21 precisely.

As the charger cleaning device 24 moves to a position in proximity to another lateral end of the charger 2 in the main scanning direction, as illustrated in FIG. 8, the tip of the contact projection 202*b* enters the clearance hole 22*c*, releasing restriction of pivoting of the wire cleaner 20 by the partition wall 22*b*.

As the charger cleaning device 24 further moves in the direction A2 depicted in FIG. 8 to another lateral end of the charger 2 in the main scanning direction, the release projection 203*b* comes into contact with the tip of the abutment portion 22*d*. Accordingly, the wire cleaner 20 pivots. As the wire cleaner 20 pivots, the discharge wire 21 moves relatively with respect to the scraping faces 202*a*1 and 203*a*1 in the sub-scanning direction (e.g., Y-direction). Thus, the discharge wire 21 separates from the pair of scraping faces 202*a*1 and 203*a*1.

When the charger cleaning device 24 reaches another lateral end of the charger 2 in the main scanning direction, the stepping, motor 27 rotates in a reverse direction, moving the charger cleaning device 24 toward one lateral end of the charger 2 in the main scanning direction (e.g., −X-direction). Accordingly, the tip of the contact projection 202*b* comes into contact with the lateral end of the clearance hole 22*c*, which is closer to one lateral end of the charger 2 in the main scanning direction. The wire cleaner 20 pivots in an opposite direction opposite to a direction in which the wire cleaner 20 pivots when the charger cleaning device 24 moves in +X-direction. The pair of cleaning pads 20*b* comes into contact with the discharge wire 21 in the sub-scanning direction (e.g., Y-Direction). As the charger cleaning device 24 moves in a direction A1 depicted in FIG. 7 toward one lateral end of the charger 2 in the main scanning direction, the contact projection 202*b* moves onto the partition wall 22*b* and the cleaning pads 20*b* engage the discharge wire 21.

Figure 12:
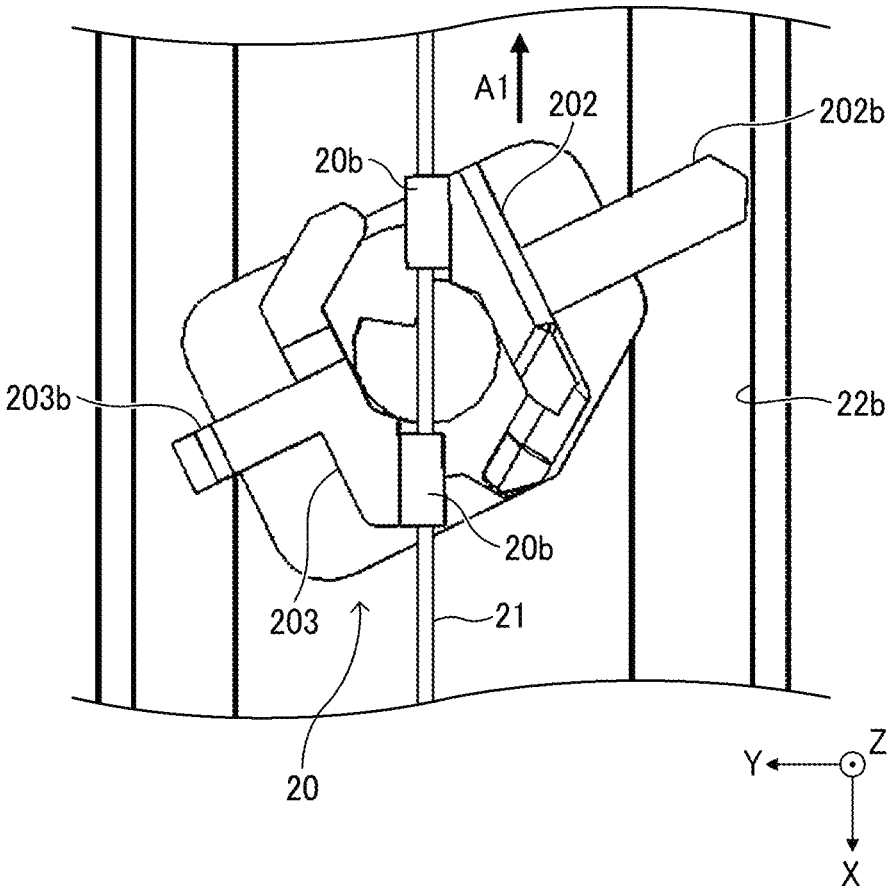
FIG. 12 is a diagram of the wire cleaner depicted in FIG. 6 that cleans the discharge wire when the charger cleaning device moves homeward from another lateral end to one lateral end of the charger in the main scanning direction.

FIG. 12 is a diagram of the wire cleaner 20 that cleans the discharge wire 21 when the charger cleaning device 24 moves homeward in the direction A1 from another lateral end to one lateral end of the charger 2 in the main scanning direction.

As illustrated in FIG. 12, when the charger cleaning device 24 moves in the direction A1 from another lateral end to one lateral end of the charger 2 in the main scanning direction (e.g., −X-direction), the pair of cleaning pads 20*b* moves while the pair of cleaning pads 20*b* slides over the discharge wire 21. Since the cleaning pads 20*b* are made of a flexible material to a certain extent, the cleaning pads 20*b* engage the discharge wire 21 such that the cleaning pads 20*b* enwrap the discharge wire 21. Hence, the cleaning pad 20*b* mounted on the cleaning portion 202 contacts the discharge wire 21 in +Y-direction, +Z-direction, and −Z-direction. The cleaning pad 20*b* mounted on the cleaning portion 203 contacts the discharge wire 21 in −Y-direction, +Z-direction, and −Z-direction. Thus, the cleaning pads 20*b* wipe the discharge wire 21, removing the foreign substance scraped by the scraping faces 202*a*1 and 203*a*1 and the side walls 202*d* and 203*d* from the discharge wire 21.

As the charger cleaning device 24 moves in the direction A1 depicted in FIG. 7 and reaches one lateral end of the charger 2 in the main scanning direction, that is, a lateral end of the charger 2 in −X-direction, the release projection 203*b* comes into contact with the abutment portion 22*d*. Accordingly, the wire cleaner 20 pivots, separating the cleaning pads 20*b* from the discharge wire 21.

As the charger cleaning device 24 moves outward and homeward as described above, the grid electrode cleaner 25 depicted in FIG. 4 slides over the grid electrode 23 depicted in FIG. 3, removing the foreign substance adhered to the grid electrode 23 therefrom. Thus, the grid electrode cleaner 25 cleans the grid electrode 23.

The embodiments described above are examples and achieve advantages in aspects below.

A description is provided of an aspect 1.

As illustrated in FIGS. 2, 4, 6, and 7, a cleaning device (e.g., the charger cleaning device 24) includes a pair of contact portions (e.g., the scraping faces 202*a*1 and 203*a*1) that contacts a discharge wire (e.g., the discharge wire 21). In a state in which the pair of contact portions sandwiches the discharge wire, the cleaning device moves in a longitudinal direction of the discharge wire and cleans the discharge wire. When the cleaning device cleans the discharge wire, the pair of contact portions sandwiches the discharge wire in a discharge direction (e.g., the discharge direction DE) in which the discharge wire discharges electric charge to a discharge target (e.g., the photoconductor 1). The discharge direction is parallel to a radial direction of the discharge wire.

A description is provided of a construction of a comparative cleaning device.

The comparative cleaning device includes a pair of contact portions that sandwiches a discharge wire in a direction perpendicular to a discharge direction in which the discharge wire discharges electric charge to a discharge target (e.g., a photoconductor). The discharge direction is parallel to a radial direction of the discharge wire. The pair of contact portions cleans the discharge wire, thus suppressing uneven discharge.

However, a foreign substance may remain on an opposed portion of the discharge wire, which is disposed opposite the discharge target. Mainly, electric charge discharged from the opposed portion of the discharge wire uniformly charges the discharge target. Hence, if the foreign substance remains on the opposed portion of the discharge wire, even after the pair of contact portions cleans the discharge wire, uneven discharge may not be eliminated sufficiently.

Conversely, according to the aspect 1, the pair of contact portions sandwiches the discharge wire in the discharge direction in which the discharge wire discharges electric charge to the discharge target. The discharge direction is parallel to the radial direction of the discharge wire. Thus, the pair of contact portions cleans the discharge wire. Accordingly, the pair of contact portions properly scrapes a foreign substance adhered to an opposed portion of the discharge wire, which is disposed opposite the discharge target, from the opposed portion of the discharge wire. Consequently, the pair of contact portions properly prevents the foreign substance from remaining on the opposed portion of the discharge wire, thus suppressing uneven discharge properly after cleaning.

A description is provided of an aspect 2,

According to the aspect 1, as illustrated in FIG. 9, the cleaning device further includes slopes (e.g., the slopes 202*c* and 203*c*) through which the discharge wire moves onto the contact portions, respectively.

Accordingly, as described above in the embodiments, the slopes guide the discharge wire onto the contact portions, respectively.

A description is provided of an aspect 3.

According to the aspect 1 or 2, as illustrated in FIG. 9, the cleaning device further includes secondary contact portions (e.g., the side walls 202*d* and 203*d*) that contact the discharge wire in a direction perpendicular to the discharge direction when the cleaning device cleans the discharge wire.

Accordingly, as described above in the embodiments, the secondary contact portions, which contact the discharge wire in the direction (e.g., Y-direction) perpendicular to the discharge direction, scrape the foreign substance adhered to orthogonal portions (e.g., sides) of the discharge wire, respectively, therefrom. The orthogonal portions extend in a direction (e.g., Z-direction) perpendicular to the main scanning direction. Thus, the secondary contact portions, which contact the orthogonal portions of the discharge wire, respectively, in the direction (e.g., Y-direction) perpendicular to the discharge direction, clean the orthogonal portions of the discharge wire.

A description is provided of an aspect 4.

According to any one of the aspects 1 to 3, the pair of contact portions is made of resin containing glass.

Accordingly, as described above in the embodiments, the pair of contact portions properly scrapes the foreign substance adhered to the discharge wire toughly from the discharge wire.

A description is provided of an aspect 5.

According to any one of the aspects 1 to 4, as illustrated in FIG. 8, the cleaning device further includes wipers (e.g., the cleaning pads 20*b*). After the pair of contact portions cleans the discharge wire, the wipers contact the discharge wire and move in the longitudinal direction of the discharge wire.

Accordingly, as described above in the embodiments, the wipers wipe the discharge wire, removing the foreign substance remaining on the discharge wire after the pair of contact portions cleans the discharge wire. Thus, the wipers prevent the foreign substance from remaining on the discharge wire after the pair of contact portions cleans the discharge wire.

A description is provided of an aspect 6.

According to the aspect 5, as illustrated in FIGS. 4, 7, and 8, the cleaning device further includes a cleaner (e.g., the wire cleaner 20) that includes the pair of contact portions and the wipers. The cleaner is pivotally supported by a cleaner support (e.g., the cleaner support 26). A driver (e.g., the stepping motor 27) depicted in FIG. 2 moves the cleaner from a first lateral end, that is, one lateral end, to a second lateral end, that is, another lateral end, of the discharge wire in the longitudinal direction thereof in a state in which the pair of contact portions contacts the discharge wire. Thereafter, a pivot mechanism (e.g., the pivot mechanism 29) pivots the cleaner bringing the wipers into contact with the discharge wire. The driver moves the cleaner from the second lateral end to the first lateral end of the discharge wire in the longitudinal direction thereof.

Accordingly, as described above in the embodiments, as the cleaner moves reciprocatingly, even after the pair of contact portions cleans the discharge wire, the cleaner causes the wipers to wipe the discharge wire, removing the foreign substance remaining on the discharge wire therefrom.

A description is provided of an aspect 7.

As illustrated in FIG. 3, a charger (e.g., the charger 2) includes the discharge wire (e.g., the discharge wire 21) and the cleaning device (e.g., the charger cleaning device 24) according to any one of the aspects 1 to 6 that cleans the discharge wire.

Accordingly, the charger suppresses uneven discharge properly.

A description is provided of an aspect 8.

According to the aspect 7, a surface of the discharge wire is treated with palladium plating.

Accordingly, as described above in the embodiments, palladium plating prevents the surface of the discharge wire from suffering from fine splits and the like caused by peeling of plating.

A description is provided of an aspect 9.

As illustrated in FIGS. 1 and 2, an image forming apparatus (e.g., the printer 100) includes a latent image bearer (e.g., the photoconductor 1) a charger (e.g., the charger 2), an exposure device (e.g., the exposure device 9), a developing device (e g., the developing device 4), and a transferor (e.g., the intermediate transfer device 5).

The charger uniformly charges a surface of the latent image bearer. The exposure device exposes the uniformly charged surface of the latent image bearer and forms an electrostatic latent image thereon. The developing device develops the electrostatic latent image formed on the latent image bearer with a developer into a toner image. The transferor transfers the toner image formed on the latent image bearer onto a recording medium (e.g., a transfer sheet). The image forming apparatus employs the charger according to the aspect 7 or 8.

Accordingly, the charger uniformly charges the surface of the latent image bearer over time, thus suppressing formation of a faulty image with vertical streaks, vertical bands, or the like over time.

A description is provided of advantages of a cleaning device (e.g., the charger cleaning device 24).

As illustrated in FIGS. 2, 6, 7, and 8, the cleaning device cleans a discharge wire (e.g., the discharge wire 21) that discharges electric charge onto a discharge target (e.g., the photoconductor 1). The cleaning device moves in a longitudinal direction of the discharge wire.

The cleaning device includes a first contact portion (e.g., the scraping face 202*a*1) that contacts and cleans the discharge wire and a second contact portion (e.g., the scraping face 203*a*1) that contacts and cleans the discharge wire. In a state in which the first contact portion and the second contact portion sandwich the discharge wire, the cleaning device moves in the longitudinal direction of the discharge wire and cleans the discharge wire. When the first contact portion and the second contact portion clean the discharge wire, the first contact portion and the second contact portion sandwich the discharge wire in a discharge direction (e.g., the discharge direction DE) in which the discharge wire discharges the electric charge onto the discharge target. The discharge direction is parallel to a radial direction of the discharge wire.

Accordingly, the cleaning device improves cleaning of the discharge wire, suppressing uneven discharge.

According to the embodiments described above, the printer 100 serves as an image forming apparatus. Alternatively, the image forming apparatus may be a copier, a facsimile machine, a multifunction peripheral (MFP) having at least two of printing, copying facsimile, scanning, and plotter functions, or the like.

The above-described embodiments are illustrative and do not limit the present disclosure. Thus, numerous additional modifications and variations are possible in light of the above teachings. For example, elements and features of different illustrative embodiments may be combined with each other and substituted for each other within the scope of the present disclosure.

Any one of the above-described operations may be performed in various other ways, for example, in an order different from the one described above.

What is claimed is:

1. A cleaning device configured to clean a discharge wire that discharges electric charge onto a discharge target and to move in a longitudinal direction of the discharge wire, the cleaning device comprising:

a first contact portion configured to contact and clean the discharge wire;

a second contact portion configured to contact and clean the discharge wire, the first contact portion and the second contact portion configured to sandwich the discharge wire in a discharge direction in which the discharge wire discharges the electric charge onto the discharge target, the discharge direction being parallel to a radial direction of the discharge wire, when the first contact portion and the second contact portion clean the discharge wire;

a first slope configured to guide the discharge wire onto the first contact portion; and a second slope configured to guide the discharge wire onto the second contact portion.

2. The cleaning device according to claim 1, wherein the first contact portion is shifted from the second contact portion in the longitudinal direction of the discharge wire.

3. The cleaning device according to claim 1, wherein the first slope is configured to abut on the first contact portion, and wherein the second slope is configured to abut on the second contact portion.

4. The cleaning device according to claim 1, further comprising:

a third contact portion configured to contact the discharge wire in a direction perpendicular to the discharge direction and clean the discharge wire; and a fourth contact portion configured to contact the discharge wire in the direction perpendicular to the discharge direction and clean the discharge wire.

5. The cleaning device according to claim 4, wherein the third contact portion is configured to abut perpendicularly on the first contact portion, and wherein the first contact portion is configured to abut perpendicularly on the second contact portion.

6. The cleaning device according to claim 1, wherein the first contact portion and the second contact portion are made of resin containing glass.

7. The cleaning device according to claim 1 further comprising:

a first wiper configured to wipe the discharge wire; and a second wiper configured to wipe the discharge wire.

8. A charger comprising:

a discharge wire configured to discharge electric charge onto a discharge target in a discharge direction; and a cleaner configured to clean the discharge wire, the cleaner comprising:

a first contact portion configured to contact and clean the discharge wire;

a second contact portion configured to contact and clean the discharge wire, the first contact portion and the second contact portion configured to sandwich the discharge wire in the discharge direction that is parallel to a radial direction of the discharge wire, when the first contact portion and the second contact portion clean the discharge wire;

a first slope configured to guide the discharge wire onto the first contact portion; and a second slope configured to guide the discharge wire onto the second contact portion.

9. The charger according to claim 8, further comprising a driver configured to move the cleaner reciprocatingly in a longitudinal direction of the discharge wire, the driver configured to move the cleaner from a first lateral end to a second lateral end of the discharge wire in the longitudinal direction of the discharge wire in a state in which the first contact portion and the second contact portion contact the discharge wire.

10. The charger according to claim 9, wherein the cleaner further comprises:

a first wiper configured to wipe the discharge wire; and a second wiper configured to wipe the discharge wire.

11. The charger according to claim 10, further comprising a pivot mechanism configured to pivot the cleaner.

12. The charger according to claim 11, wherein the pivot mechanism comprises:

a clearance hole; and a projection configured to move through the clearance hole.

13. The charger according to claim 11, wherein, when the cleaner reaches the second lateral end of the discharge wire in the longitudinal direction of the discharge wire, the pivot mechanism is configured to pivot the cleaner to bring the first wiper and the second wiper into contact with the discharge wire.

14. The charger according to claim 13, wherein the driver is configured to move the cleaner from the second lateral end to the first lateral end of the discharge wire in the longitudinal direction of the discharge wire in a state in which the first wiper and the second wiper contact the discharge wire.

15. The charger according to claim 8, wherein a surface of the discharge wire is treated with palladium plating.

16. An image forming apparatus comprising:

a latent image bearer; and a charger configured to uniformly charge a surface of the latent image bearer, the charger comprising:

a discharge wire configured to discharge electric charge onto the latent image bearer in a discharge direction;

a cleaning device configured to clean the discharge wire; and a driver configured to move the cleaning device in a longitudinal direction of the discharge wire, the cleaning device comprising:

a first contact portion disposed opposite the latent image bearer via the discharge wire, the first contact portion configured to contact and clean the discharge wire;

a second contact portion interposed between the discharge wire and the latent bearer, the second contact portion configured to contact and clean the discharge wire;

a first slope configured to guide the discharge wire onto the first contact portion; and a second slope configured to guide the discharge wire onto the second contact portion.

* * * * *